US007040678B1

(12) United States Patent
Haakenson

(10) Patent No.: US 7,040,678 B1
(45) Date of Patent: May 9, 2006

(54) HOLDER FOR BEVERAGE CONTAINER

(75) Inventor: Kevin M. Haakenson, Laguna Beach, CA (US)

(73) Assignee: Blue Thunder Products, LLC, Corona Del Mar, NV (US)

( * ) Notice: Subject to any disclaimer, the term of this patent is extended or adjusted under 35 U.S.C. 154(b) by 346 days.

(21) Appl. No.: 10/622,930

(22) Filed: Jul. 18, 2003

(51) Int. Cl.
*B65D 25/28* (2006.01)

(52) U.S. Cl. ..... 294/27.1; 294/32; D7/623

(58) Field of Classification Search ..... 294/27.1, 294/31.2, 32, 33, 165; 220/737, 739, 741, 220/742; 215/396; D7/619.2, 623, 625, D7/628; 36/34 R, 34 A
See application file for complete search history.

(56) References Cited

U.S. PATENT DOCUMENTS

| | | | | | |
|---|---|---|---|---|---|
| 1,775,335 | A | * | 4/1930 | Roman | 294/28 |
| 2,088,387 | A | * | 7/1937 | Rice, Jr. et al. | 215/395 |
| 2,359,187 | A | * | 9/1944 | Alsdorf | 222/470 |
| D165,683 | S | | 1/1952 | Fournier et al. | |
| D216,425 | S | | 1/1970 | Foster | D22/99 |
| 3,610,671 | A | * | 10/1971 | Conger | 294/33 |
| D232,209 | S | * | 7/1974 | Edwards | D7/622 |
| D261,848 | S | | 11/1981 | Hayden, Jr. | D7/45 |
| D262,084 | S | | 12/1981 | Hayden, Jr. | D7/45 |
| D262,766 | S | | 1/1982 | Hayden, Jr. | D7/45 |
| D262,853 | S | | 2/1982 | Hayden, Jr. | D7/45 |
| D262,854 | S | | 2/1982 | Hayden, Jr. | D7/45 |
| D264,417 | S | | 5/1982 | Urda, Jr. et al. | |
| 4,461,100 | A | * | 7/1984 | Minor et al. | 36/72 B |
| D282,890 | S | | 3/1986 | Satterfield | D7/5 |
| D282,891 | S | | 3/1986 | Satterfield | D7/5 |
| 4,817,810 | A | * | 4/1989 | Shull | 220/741 |
| 4,936,614 | A | * | 6/1990 | Russell | 294/27.1 |
| 5,013,074 | A | | 5/1991 | Galle | 294/33 |
| D349,217 | S | | 8/1994 | Spencer | D7/625 |
| 5,816,631 | A | | 10/1998 | Kochan | 294/33 |
| 5,819,997 | A | | 10/1998 | Mathis et al. | 224/148.4 |
| D433,880 | S | | 11/2000 | Herrera | D7/625 |

FOREIGN PATENT DOCUMENTS

EP 0 869 070 A1 10/1998

* cited by examiner

*Primary Examiner*—Dean J. Kramer
(74) *Attorney, Agent, or Firm*—James G. O'Neill; Klein, O'Neill Singh, LLP

(57) ABSTRACT

A holder for a beverage or drink container having an appearance suggestive of a high-heeled shoe comprises a base having a substantially planar lower surface and an opposite upper surface containing a receptacle configured to slidably receive the lower end portion of the container. An elongated handle is disposed adjacent to the base, and includes an upper end disposed above the upper surface of the base, and an opposite, substantially planar lower end disposed co-planar with the lower surface of the base. The base is rigidly connected to the upper end of the handle by an arcuate web. First, second and third straps are arranged on the holder to capture the container in the holder and restrain it against lateral movement. The holder can be manufactured inexpensively using a wide variety of manufacturing techniques and a wide variety of strong, decorative materials.

20 Claims, 1 Drawing Sheet

HOLDER FOR BEVERAGE CONTAINER

CROSS-REFERENCE TO RELATED APPLICATIONS

This Application is related to U.S. Des. App. Ser. No. 29/187,616, filed Aug. 4, 2003, entitled Holder for Drink Container, the disclosure of which is incorporated herein by this reference.

BACKGROUND OF THE INVENTION

1. Field of the Invention

This application is related to holders for beverage or drink containers in general, and in particular, to a holder for a beverage container that has the appearance of a high-heel shoe.

2. Description of Related Art

Drink containers having unconventional shapes, e.g., that of an animal, a head, or even footwear, are popular and known in the art. Thus, examples of or mugs shaped like footwear can be found in U.S. Pat. Nos.: Des. 264,417 to J. Urda, Jr. et al.; Des. 282,891 to R. Satterfield; and, Des. 282,890 to R. Satterfied.

It is also known to dispose a beverage container, such as a can, bottle, glass or the like, on a coaster and/or clad it in a jacket that insulates the drinker's fingers and tabletops against extreme hot and cold temperatures of the beverage held in the container, as well as from condensation that may form on the container's exterior surface. It is also known to imbue these jacket-type coasters with the appearance of footwear, such as a "sneaker," as exemplified in U.S. Pat. Nos. Des. 349,217 to J. Spencer; Des. 433,880 to F. Herrera; Des. 262,854 to M. Hayden, Jr.; Des. 262,853 to M. Hayden, Jr.; Des. 262,766 to M. Hayden, Jr.; 262,084 to M. Hayden, Jr.; and Des. 261,848 to M. Hayden, Jr.

It is further known to provide a holder for a beverage container, such as a large plastic soft drink bottle, with a handle that can be easily grasped by the user so that the bottle can be lifted with less risk of slipping, and its contents can be poured out with less risk of spilling. Examples of such bottle holders with handles may be found in, e.g. European Pat. App. No. EP 0 869 070 A1 by L. Rubini; U.S. Pat. No. 5,816,631 to B. Kochan; and, U.S. Pat. No. 5,013, 074 to N Galle.

While each of the foregoing examples of the related art provide their user with some measure of beneficial utility, none presents the combined benefits of a holder for a beverage container that incorporates the appearance of footwear, viz., a high-heeled shoe, the insulative qualities of a jacket-type coaster, and the safety and convenience of a handle that is more easily grasped by the user. Accordingly, it is an object of the present invention to disclose, and to secure the protection of U.S. Letters Patent for, a holder for a beverage container that incorporates the appearance of footwear, viz., a high-heeled shoe, the insulating qualities of a jacket-type coaster, and the safety and convenience of an easily grasped handle.

BRIEF SUMMARY OF THE INVENTION

In accordance with this invention, a holder is provided for a beverage or drink container that incorporates the appearance of a high-heeled shoe, the insulating qualities of a jacket-type coaster, and the safety and convenience of a handle that enables the container to be lifted and drunk from easily and conveniently without direct contact between the container or the user's fingers.

In an exemplary preferred embodiment thereof, the novel holder comprises a base having the appearance of the forefoot portion of a high-heel shoe. The base includes a substantially planar lower surface and an opposite upper surface containing a recess, or receptacle, configured to slidably receive, support and restrain the lower end portion of a beverage container against lateral movement. An elongated handle having the appearance of the heel portion of a high-heel shoe is disposed adjacent to the base, and includes an upper end disposed above the upper surface of the base, and an opposite, substantially planar lower end disposed coplanar with the lower surface of the base, such that the holder rests on the lower surfaces of both the base and the handle when placed on a table. An arcuate web having the appearance of the arch portion of a high-heel shoe rigidly connects the base to the upper end of the handle.

The exemplary holder further comprises a first strap having opposite ends respectively attached to opposite sides of the web. An intermediate portion of the first strap is arranged to contact and restrain an upper portion of a tall beverage container against lateral movement. The first strap may further comprise a second strap having opposite ends respectively connected to the first strap intermediate of the ends thereof such that an intermediate portion of the second strap contacts the upper portion of the container on a side of the container opposite to the intermediate portion of the first strap to further restrain the upper portion of the container against lateral movement. The first strap may include a pair of opposing, intermediate ends that can be separated to define an opening in the strap for the easy insertion of the container into the holder, along with means for releasably fastening the intermediate ends of the strap together, such as a buckle, a hook-and-eye fastener, snap, or the like.

In another possible embodiment, the holder may include a third strap having opposite ends respectively attached to opposite sides of the base and an intermediate portion arranged to contact and restrain a middle portion of the container against lateral movement. This third strap may comprise an elastic material, such that the beverage container can be inserted into the holder and through the strap without the need for a releasable strap fastener. Furthermore, the base may be made from a resilient or expandable material to allow various size containers to be inserted and removed therefrom.

The novel holder can be manufactured using a wide variety of manufacturing techniques, including injection molding, and of a wide variety of materials, including a resilient or expandable material, and/or a strong, colorful, yet inexpensive plastic.

A better understanding of the above and many other features and advantages of the invention may be obtained from a consideration of the detailed description thereof below, particularly if such consideration is made in conjunction with the appended drawings.

DETAILED DESCRIPTION OF THE INVENTION

Figures 1, 2, 3, 4:
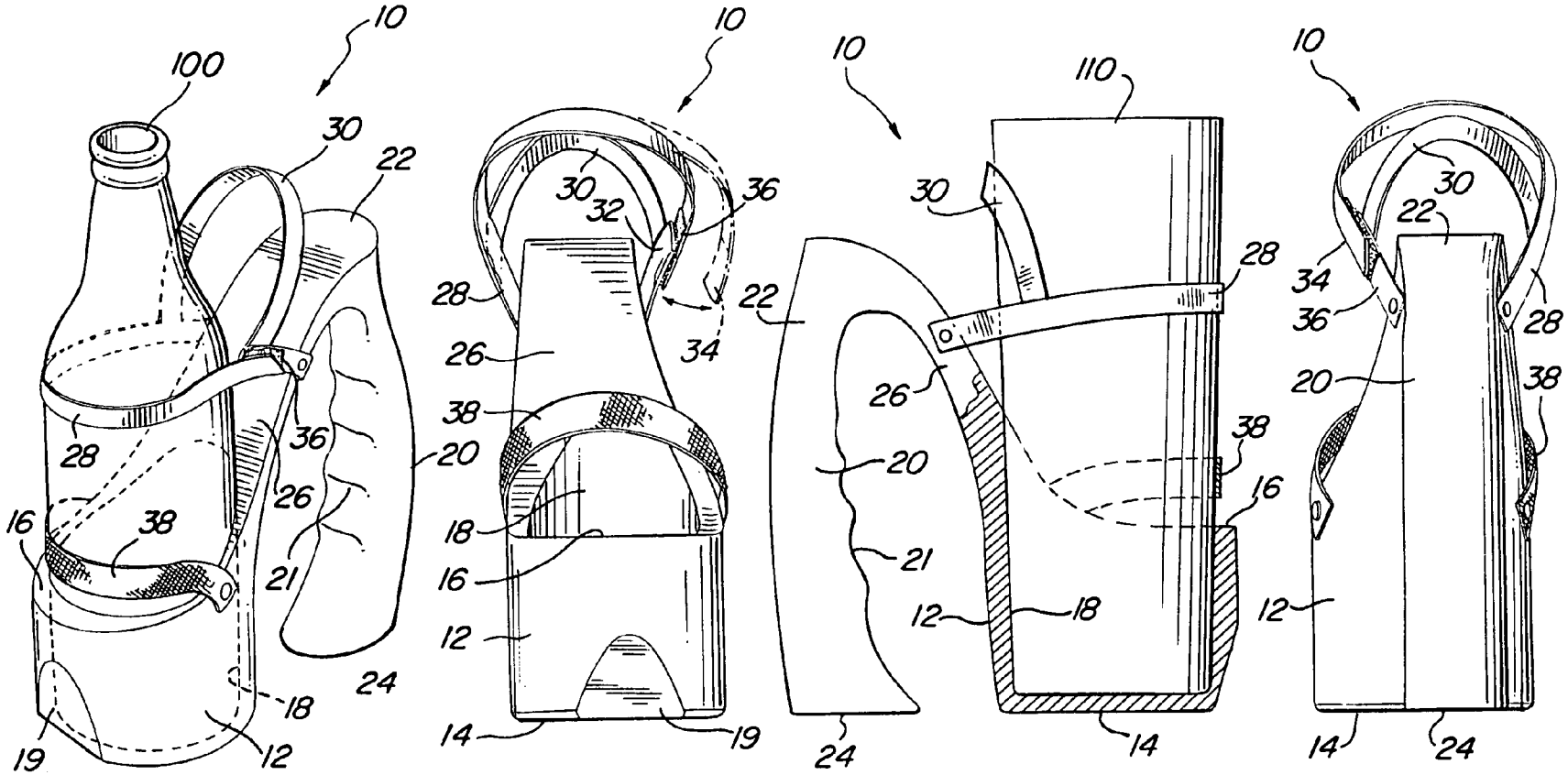
FIG. 1 is front-and-side perspective view of an exemplary embodiment of a holder for a beverage container in accordance with the present invention, shown holding a bottle-type beverage container.
FIG. 2 is a front elevation view of the exemplary holder.
FIG. 3 is a side elevation view of the exemplary holder, shown holding a glass or tumbler-type of beverage container; and, FIG. 4 is a rear elevation view of the exemplary holder.

An exemplary embodiment of a holder 10 for a drink or beverage container 100 in accordance with the present invention is illustrated in FIGS. 1–4. As may be seen from the figures, the holder has an appearance suggestive of a high-heel shoe. In the perspective view of FIG. 1, the holder is shown holding a bottle-type beverage container, and in the side elevation view of FIG. 3, the holder is shown holding a drinking-glass or tumbler-type of container 110. It is to be undertood that any other type of a drink or beverage container 100, 110, such as a can or the like, could be held in the holder 10.

With reference to the figures, the holder 10 comprises a base 12 that has a shape suggestive of the forefoot portion of a high-heel shoe. The base includes a substantially planar lower surface 14 and an opposite upper surface 16 containing a generally cylindrical opening or receptacle 18 that extends from the upper surface toward the lower surface and which is sized and shaped to slidably receive, support and restrain a lower end portion of the beverage container 100 against lateral movement. The base may be formed from an expandable or resilient material, and if desired, may have a separable insert held therein. The front of the base my also include a chamfer 19 to simulate the appearance of an open-toed shoe.

An elongated handle 20 having the appearance of the heel portion of a high-heel shoe is disposed adjacent to and spaced apart from the base 12 of the holder 10 to enable the safe and convenient lifting and tilting of the holder 10 and any container 100 held therein, for carrying or drinking. The handle 20 has an upper end 22 disposed above the upper surface 16 of the base and an opposite, substantially planar lower end 24 disposed coplanar with the lower surface of the base. Thus, when the holder is resting on a flat surface, such as a tabletop, the handle acts like an outrigger on a canoe to enhance the lateral stability of the holder. Additionally, the handle 20 includes an inner portion or surface 21, facing the base 12, having a plurality of ribs or finger holding portions to enable a user to more securely grasp the holder 10.

The base 12 of the holder 10 is rigidly connected to the upper end 22 of the handle 20 by an arcuate web 26 that extends between the upper end 22 and the upper surface 16 of the base and has a configuration suggestive of the arch portion of a high-heel shoe. By providing a rigid connection between the base 12 and the handle 10, the web 26 enables the base, and hence any beverage container 100, 110 held therein, to be conveniently manipulated with the handle.

In keeping with the high-heel shoe motif, the holder 10 further comprises a first strap 28, that may be non-resilient or resilient, but that is preferably non-resilient. This first strap 28 is suggestive of an ankle strap on a high heel shoe. The first strap, which may be comprised of leather or a resilient, shiny plastic, such as vinyl, has two opposite ends respectively attached to opposite sides of the web 26, for example, with fasteners such as pins or rivets, and an intermediate portion arranged to contact a side of an upper portion of the container 100, to restrain it against lateral movement, as illustrated in FIG. 1 in conjunction with the bottle-type container. The first flexible strap 28 may further comprise a second strap 30 which has opposite ends respectively connected to the first strap intermediate of the two ends thereof, and an intermediate portion arranged to contact the upper portion of the container on a side of the container 110 opposite to the intermediate portion of the first strap, to thereby further restrain the upper portion of the container against lateral movement, as illustrated in FIG. 3.

To enable the beverage container 100, 110 to be easily inserted in the holder 10, the first strap 28 may include a pair of opposing, intermediate ends 32 and 34 that define an opening in the strap when the ends are separated, as illustrated in FIG. 2, together with means 36 for releasably fastening the intermediate ends of the strap together such that the intermediate portion of the strap contacts the upper portion of the container and holds it snugly in the holder, as illustrated in FIGS. 1 and 3. The fastening means may comprise a simple buckle or snap, or as shown in the particular embodiment illustrated in the figures, may comprise a hook-and-loop type of fastener, such as Velcro.

In addition to the first and second straps 28 and 30 described above, a third strap 38 may be provided to retain the container 100, 110 in the holder 10 more securely. As illustrated in the figures, the third strap has opposite ends respectively attached to opposite sides of the base 12 and an intermediate portion arranged to contact and restrain a middle portion of the container against lateral movement. In a preferred embodiment, the second strap is comprised of an elastic material, such as rubber or the like, that stretches to enable the container to be slipped through the strap and into the receptacle 18 without the need of a closure device.

The holder 10 can be manufactured inexpensively using a wide variety of manufacturing techniques, and can be made of a wide variety of materials, such as strong, decorative materials in any desired color or style. For example, the base 12 may be formed from a different material, or the base, heel 20 and web 26 can all be sculpted from a strong wood, such as ash or birch, using ordinary powered wood-working equipment, then assembled, e.g., with fasteners and/or an adhesive, and finished with decorative paints, stains and varnishes. It is also possible to sculpt at least two, and preferably, all three of the base, handle and web integrally of each other and from a single piece of wood. Alternatively, the holder can be injection molded from a wide variety of strong, colorful plastics, e.g., polyurethane, and as above, at least two, and preferably, all three of the base, handle and web can be molded integrally of each other in a single piece and simultaneously in a single "shot." As described above, the base 12 may be formed from a separate resilient or expandable material, with or without a liner, to accommodate different size and shaped beverage containers.

Although the holder 10 may be of any desired size or shape, in a currently preferred embodiment of the holder, the base is about 3 to 3 and ½ inches in diameter, the overall holder is about 5 and ½ to six inches long as shown in FIG. 3, and the handle or heel portion 20 is about 5 and ½ to six inches high. The heel 20 may be made hollow or solid, depending on the materials used, and is preferably somewhat narrower at the top to provide the desired appearance of a high-heeled shoe.

Indeed, as those of skill in this art will recognize, many modifications and variations are possible in terms of the materials and techniques employed in the present invention without departing from its spirit and scope. Accordingly, the scope of the present invention should not be limited to that of the particular embodiments described and illustrated herein, as these are merely exemplary in nature. Rather, the scope of the present invention should be commensurate with that of the claims appended hereafter and the functional equivalents thereof.

What is claimed is:

1. A holder for a beverage container, the holder comprising:

a base having a substantially planar lower surface and an opposite upper surface containing a receptacle configured to slidably receive, support and restrain a lower end portion of a beverage container against lateral movement;

an elongated handle disposed adjacent to the base, the handle having an upper end disposed above the upper surface of the base and an opposite, substantially planar lower end disposed coplanar with the lower surface of the base;

an arcuate web rigidly connecting the base to the upper end of the handle, a first strap having opposite ends respectively attached to opposite sides of the web and an intermediate portion arranged to contact a side of an upper portion of a beverage container so as to restrain it against lateral movement;

the first strap further comprising a second strap having opposite ends respectively connected to the first strap intermediate of the ends of the first strap and an intermediate portion arranged to contact the upper portion of a beverage container on a side of a beverage container opposite to the intermediate portion of the first strap and further restrain an upper portion of a beverage container against lateral movement; and wherein the holder has an appearance suggestive of a high-heeled shoe.

2. The holder of claim 1, wherein the first strap comprises a pair of opposing, intermediate ends, and further comprising means for releasably fastening the intermediate ends of the first strap together.

3. The holder of claim 2, wherein the fastening means comprises a hook-and-eye fastener.

4. The holder of claim 1, further comprising a third strap having opposite ends respectively attached to opposite sides of the base and an intermediate portion arranged to contact and restrain a middle portion of a beverage container against lateral movement.

5. The holder of claim 4, wherein the third strap is elastic and an inner portion of the elongated handle, facing the base, has a plurality of ribs formed thereon.

6. The holder of claim 1, wherein at least two of the base, elongated handle and web are integrally formed and an inner portion of the elongated handle, facing the base, has a plurality of finger holding portions formed thereon to enable a user to more securely grasp the holder.

7. The holder of claim 6, wherein the at least two of the base, handle and web are sculpted from a single piece of material.

8. The holder of claim 6, wherein the at least two of the base, handle and web are molded of a single piece of material.

9. A holder for a beverage container comprising:

a base having a substantially planar lower surface and an opposite upper surface containing a receptacle configured to slidably receive, support and restrain a lower end portion of the beverage container against lateral movement;

an elongated handle disposed adjacent to the base, the handle having an upper end disposed above the upper surface of the base and an opposite, substantially planar lower end disposed coplanar with the lower surface of the base;

an arcuate web rigidly connecting the base to the upper end of the handle;

a first strap having opposite ends respectively attached to opposite sides of the web and an intermediate portion arranged to contact a side of an upper portion of a beverage container so as to restrain it against lateral movement; wherein the holder has an appearance suggestive of a high-heeled shoe; and the first strap further comprises a second strap having opposite ends respectively connected to the first strap intermediate of the ends of the first strap and an intermediate portion arranged to contact the upper portion of the beverage container on a side of the beverage container opposite to the intermediate portion of the first strap and further restrain an upper portion of the beverage container against lateral movement; and wherein the first strap comprises a pair of opposing, intermediate ends having means for releasably fastening the intermediate ends of the first strap together.

10. The holder of claim 9, further comprising a third strap having opposite ends respectively attached to opposite sides of the base and an intermediate portion arranged to contact and restrain a middle portion of the beverage container against lateral movement.

11. The holder of claim 10 wherein the third strap is resilient and an inner portion of the elongated handle, facing the base, has a plurality of finger holding portions formed thereon to enable a user to more securely grasp the holder.

12. The holder of claim 9 wherein at least two of the base, handle and web are integrally formed and an inner portion of the elongated handle, facing the base, has a plurality of finger holding portions formed thereon to enable a user to more securely grasp the holder.

13. The holder of claim 12 wherein the at least two of the base, handle and web are sculpted from a single piece of material.

14. The holder of claim 12 wherein the at least two of the base, handle and web are molded of a single piece of material.

15. A holder in combination with a beverage container, comprising:

a beverage container adapted to be held in the holder;

the holder having a base with a substantially planar lower surface and an opposite upper surface containing a receptacle configured to slidably receive, support and restrain a lower end portion of the beverage container against lateral movement;

an elongated handle disposed adjacent to the base, the handle having an upper end disposed above the upper surface of the base and an opposite, substantially planar lower end disposed coplanar with the lower surface of the base, and an inner portion of the elongated handle, facing the base, having a plurality of finger holding portions formed thereon to enable a user to more securely grasp the holder;

an arcuate web rigidly connecting the base to the upper end of the handle;

a first strap having opposite ends respectively attached to opposite sides of the web and an intermediate portion arranged to contact a side of an upper portion of a beverage container so as to restrain it against lateral movement; and a second strap having opposite ends respectively connected to the first strap intermediate of the ends of the first strap and an intermediate portion arranged to contact the upper portion of the beverage container on a side of the beverage container opposite to the intermediate portion of the first strap and further restrain an upper portion of the beverage container against lateral movement; and wherein the first strap comprises a pair of opposing, intermediate ends having means for releasably fastening the intermediate ends of the first strap together wherein the holder has an appearance suggestive of a high-heeled shoe.

16. The holder of claim 15, further comprising a resilient third strap having opposite ends respectively attached to opposite sides of the base and an intermediate portion arranged to contact and resiliently restrain a middle portion of the beverage container against lateral movement.

17. The holder of claim 15 wherein at least two of the base, handle and web are integrally formed from a single piece of material.

18. A holder for a beverage container, the holder comprising:

a base having a substantially planar lower surface and an opposite upper surface containing a generally cylindrical receptacle extending between the substantially planar lower surface and the opposite upper surface and configured to slidably receive, support and restrain a lower end portion of a beverage container against lateral movement therein;

an elongated handle disposed adjacent to the base, the handle having an upper end disposed above the upper surface of the base and an opposite, substantially planar lower end disposed coplanar with the lower surface of the base;

an arcuate web rigidly connecting the upper surface of the base to the upper end of the handle; and wherein the holder has an appearance suggestive of a high-heeled shoe.

19. The holder of claim 18, further comprising a first strap having opposite ends respectively attached to opposite sides of the web and an intermediate portion arranged to contact a side of an upper portion of a beverage container so as to restrain it against lateral movement.

20. A holder for a beverage container comprising:

a base having a substantially planar lower surface and an opposite upper surface containing a generally cylindrical receptacle extending between the substantially planar lower surface and the opposite upper surface and configured to slidably receive, support and restrain a lower end portion of the beverage container against lateral movement;

an elongated handle disposed adjacent to the base, the handle having an upper end disposed above the upper surface of the base and an opposite, substantially planar lower end disposed coplanar with the lower surface of the base;

an arcuate web rigidly connecting the upper surface of the base to the upper end of the handle; and a first strap having opposite ends respectively attached to opposite sides of the web and an intermediate portion arranged to contact a side of an upper portion of a beverage container so as to restrain it against lateral movement; wherein the holder has an appearance suggestive of a high-heeled shoe.

* * * * *